US005616039A

United States Patent [19]

Morley

[11] Patent Number: 5,616,039

[45] Date of Patent: Apr. 1, 1997

[54] SYSTEM FOR SELECTIVELY EFFECTING ELECTRICAL CONNECTION AMONG A PLURALITY OF LOCI IN A HOUSING

[75] Inventor: Edwin R. Morley, Two Rivers, Wis.

[73] Assignee: Paragon Electric Company, Inc., Two Rivers, Wis.

[21] Appl. No.: 376,400

[22] Filed: Jan. 23, 1995

[51] Int. Cl.[6] ..... H01R 29/00

[52] U.S. Cl. ..... 439/188

[58] Field of Search ..... 439/188, 489, 439/490, 911

[56] References Cited

U.S. PATENT DOCUMENTS

| | | | |
|---|---|---|---|
| 3,627,929 | 12/1971 | Viigmen et al. . | |
| 4,887,974 | 12/1989 | Ichimura et al. | 439/259 |
| 4,915,649 | 4/1990 | Shimazu et al. | 439/490 |
| 4,954,672 | 9/1990 | Ruehl | 200/51.09 |
| 5,041,017 | 8/1991 | Nakazato et al. | 439/509 |
| 5,064,973 | 11/1991 | Zinn et al. | 200/51.1 |
| 5,112,246 | 5/1992 | Kawase et al. | 439/489 |
| 5,201,667 | 4/1993 | Endo et al. | 439/189 |
| 5,276,415 | 1/1994 | Lewandowski et al. | 439/188 |
| 5,462,449 | 10/1995 | Tsuji et al. | 439/188 |

FOREIGN PATENT DOCUMENTS 61-186180 8/1986 Japan .

*Primary Examiner*—Gary F. Paumen
*Attorney, Agent, or Firm*—Foley & Lardner

[57] ABSTRACT

An improved system for selectively effecting electrical connection intermediate a plurality of electrical leads at a plurality of loci in a housing. The housing includes a first housing portion and a second housing portion configured to engage in a predetermined orientation during assembly of the housing. The system includes an electrical bridging member located in one housing portion. The bridging member has a plurality of bias units, each of which is situated substantially at a respective locus of the plurality of loci. The system further includes a bearing member which is located in the other housing portion and includes a plurality of urging units; there is a respective urging unit substantially in register with each respective locus when the first housing portion and the second housing portion are in the predetermined orientation. The plurality of urging units cooperate with the plurality of bias units during assembly to engage each respective bias unit with a respective electrical lead of the plurality of electrical leads at each respective locus to selectively electrically connect the respective electrical leads.

21 Claims, 4 Drawing Sheets

SYSTEM FOR SELECTIVELY EFFECTING ELECTRICAL CONNECTION AMONG A PLURALITY OF LOCI IN A HOUSING

BACKGROUND OF THE INVENTION

It is often necessary to establish an electrical connection among electrical leads at various loci within a housing containing a device. The leads may emanate from elements within the housing or may lead into the housing from devices situated outside the housing for connection with elements within the housing. It is cumbersome, time consuming, and labor intensive to effect solder connection among leads within a housing. Further, such solder connections may require rework (in the case of a cold solder joint), or may otherwise provide substandard electrical connection because of such factors as vibration, heat, impurities, or the like.

It would be useful to provide a structure which permits electrical connection among a plurality of leads at a plurality of loci in a housing during assembly of the housing. Mechanical imposition of a bridging structure among selected electrical leads provides a structure for effecting such electrical connection during assembly.

It would also be useful to have such a structure which may be selectively employed for effecting differing electrical connections at different loci, depending upon the apparatus with which it is employed.

SUMMARY OF THE INVENTION

An improved system for selectively effecting electrical connection intermediate a plurality of electrical leads at a plurality of loci in a housing. The housing includes a first housing portion and a second housing portion configured to engage in a predetermined orientation during assembly of the housing. The system comprises an electrical bridging member located in one housing portion of the first housing portion and the second housing portion. The bridging member has a plurality of bias units, each of which is situated substantially at a respective locus of the plurality of loci. The system further comprises a bearing member which is located in the other housing portion and includes a plurality of urging units; there is a respective urging unit substantially in register with each respective locus when the first housing portion and the second housing portion are in the predetermined orientation. The plurality of urging units cooperate with the plurality of bias units during assembly to engage each respective bias unit with a respective electrical lead of the plurality of electrical leads at each respective locus to selectively electrically connect the respective electrical leads.

Such a structure facilitates orientation of components to effect housing assembly and electrical connection with a straightforward linear pressing motion. Such simple motions are particularly useful for automatic implementation.

It is, therefore, an object of the present invention to provide an improved system for selectively effecting electrical connection at a plurality of loci in a housing which may be automatically implemented.

It is a further object of the present invention to provide an improved system for selectively effecting an electrical connection in a plurality of loci in a housing which is configured to selectively accommodate a plurality of different applications with a single structure.

Further objects and features of the present invention will be apparent from the following specification and claims when considered in connection with the accompanying drawings illustrating the preferred embodiment of the present invention.

DETAILED DESCRIPTION OF THE INVENTION

Figure 1:
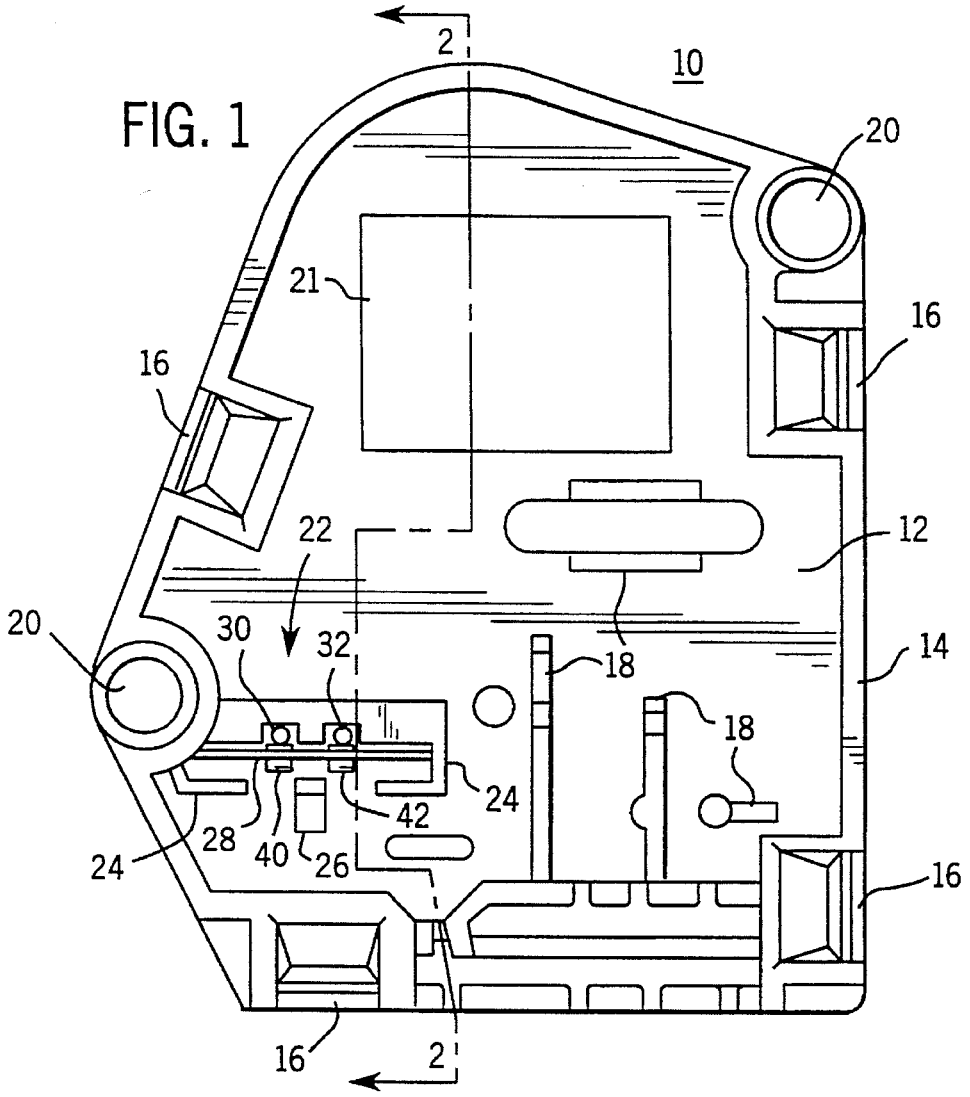
FIG. 1 is a top plan view of one housing portion appropriately configured for employment of the present invention.

FIG. 1 is a top plan view of one housing portion appropriately configured for employment of the present invention. In FIG. 1, a housing portion 10 includes a base section 12, a peripheral skirt 14, tab receiving latch mechanisms 16, a plurality of protrusions 18, and a plurality of apertures 20. Protrusions 18 and apertures 20 are representatively indicated in FIG. 1. Housing portion 10 is preferably manufactured of molded plastic material; the size, shape, and location of the various protrusions 18 and apertures 20 may be of significant variety to accommodate different particular uses for housing portion 10 such as switch housing, motor housing, or the like, as is within the capability of those skilled in the art of molding plastic materials. Tab receiving mechanisms 16 are configured and located appropriately to receive tabs from a substantially mating other housing portion (not shown in FIG. 1) to provide an assembled housing of two housing portions such as housing portion 10. Such an assembled housing may be configured to contain a mechanism or device 21 (shown schematically in FIG. 1) in a cavity established intermediate the two housing portions making up the housing.

Included in housing portion 10 among the various protrusions 18 and apertures 20 is an electrical connection system 22. Electrical connection system 22 includes buttressing protrusions 24, 26 which support a bridging contact member 28 generally adjacent electrical leads 30, 32.

In order to facilitate understanding the present invention, like elements will be labeled using like reference numerals in the various figures.

Figure 2:
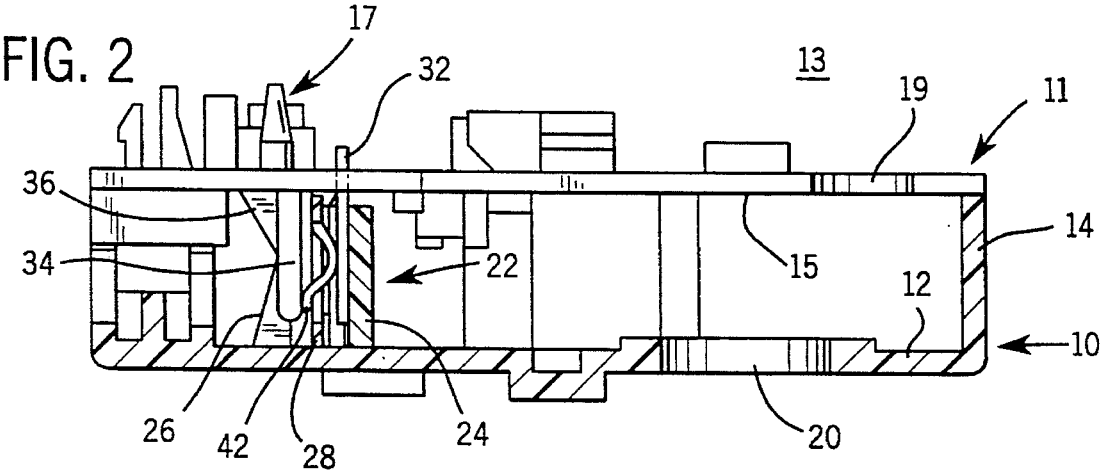
FIG. 2 is a partially sectioned side view of the housing portion illustrated in FIG. 1, viewed along section 2—2 of FIG. 1, engaged with another housing portion to form a housing assembly.
Figure 3:
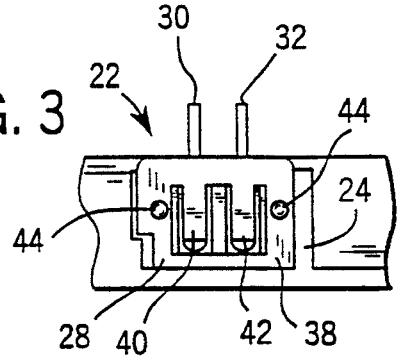
FIG. 3 is a detail of a portion of the bridging member employed in the invention illustrated in FIGS. 1 and 2.

FIG. 2 is a partially sectioned side view of the housing portion illustrated in FIG. 1, viewed along section 2—2 of FIG. 1, engaged with another housing portion to form a housing assembly. In FIG. 2, housing portion 10 is engaged with a housing portion 11. Housing portion 11 engages housing portion 10 substantially atop peripheral skirt 14 above base section 12 of housing portion 10. Electrical connection system 22 is illustrated in side view in FIG. 2 revealing protrusion 26 as having a substantially trapezoidal profile. Bridging contact member 28 has a curved biased profile in predetermined areas (see contact members 40, 42; FIG. 3), and is preferably manufactured of a metal having spring bias properties when bent appropriately. Bridging contact member 28 is, in the assembled housing assembly 13 illustrated in FIG. 2, urged against electrical lead 32 by a pin member 34. Pin member 34 is preferably integrally formed with housing portion 11. Housing portion 11 has a base section 15 with which a plurality of protrusions 17 and apertures 19 are associated. Pin member 34 extends from base section 15 of housing portion 11, and has an integral buttressing structure 36. Buttressing structure 36 provides strength and rigidity to pin member 34 during assembly of housing assembly 13 by engagement of housing portions 10, 11. In the assembled orientation illustrated in FIG. 2, pin member 34 is situated substantially adjacent electrical lead 32 with bridging contact member 28 intermediate pin member 34 and electrical lead 32. Thus, a contact member 42 of bridging contact member 28 (described in greater detail in connection with FIG. 3) is urged against electrical lead 32 by pin member 34 when housing assembly 13 is assembled by appropriately engaging housing portions 10, 11. Similarly, a matching pin member (not shown in FIG. 2) urges a matching contact member 40 (see FIG. 3) of bridging contact member 28 against electrical lead 30 (see FIG. 1) to effect electrical connection between bridging member 28 and electrical lead 30. Since bridging member 28 is electrically continuous, such urging by pin member 34 and its matching pin member associated with electrical lead 30 effects electrical connection intermediate electrical leads 30, 32.

Thus, any component electrically connected to electrical lead 30 is electrically connected to a component connected with electrical lead 32 by the mere engagement of housing portions 10, 11 to form housing assembly 13; no other manufacturing step, such as soldering, application of conducted epoxy adhesive, or the like is required to effect that electrical connection.

FIG. 3 is a detail of a portion of the bridging member employed in the invention illustrated in FIGS. 1 and 2. In FIG. 3, electrical connection system 22 is illustrated as including bridging contact member 28 mounted substantially adjacent but not in electrical contact with electrical leads 30, 32. Bridging contact member 28 includes a base member 38 and integral stamped bearing members or contact members 40, 42. Contact members 40, 42 are electrically continuous with base member 38 and, preferably, are stamped from a blank electrically conductive metal component in a manner to integrally form base member 38 and contact members 40, 42. Mounting dimples 44 provide mechanical interference between protrusion 24 and bridging contact member 28 to ensure bridging contact member 28 remains in place during assembly. Additionally (or, alternatively) bridging contact member may be screw mounted, or heat staked, or plastic pin mounted, or mounted to protrusion 24 by other mountings known in the art for fixing a part to a plastic component.

Figure 4:
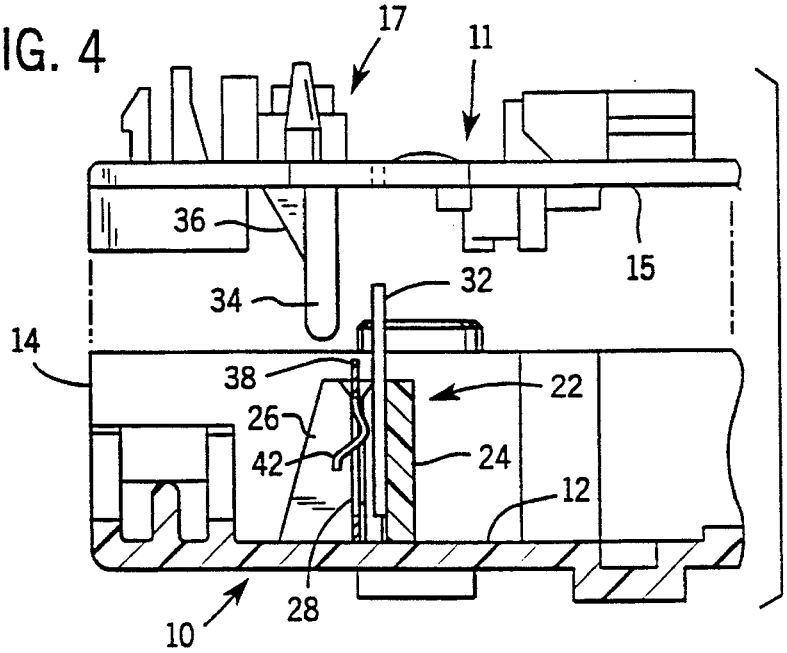
FIG. 4 is a detail of a portion of the invention illustrated in FIGS. 1–3, showing two housing portions poised for assembly.

FIG. 4 is a detail of a portion of the invention illustrated in FIGS. 1–3, showing two housing portions poised for assembly. In FIG. 4, housing portion 11 is poised adjacent housing portion 10, substantially in register with housing portion 10, and ready for engagement to form a housing assembly, such as housing assembly 13 of FIG. 2. Pin member 34 is generally in register with a location adjacent contact member 42.

Figure 5:
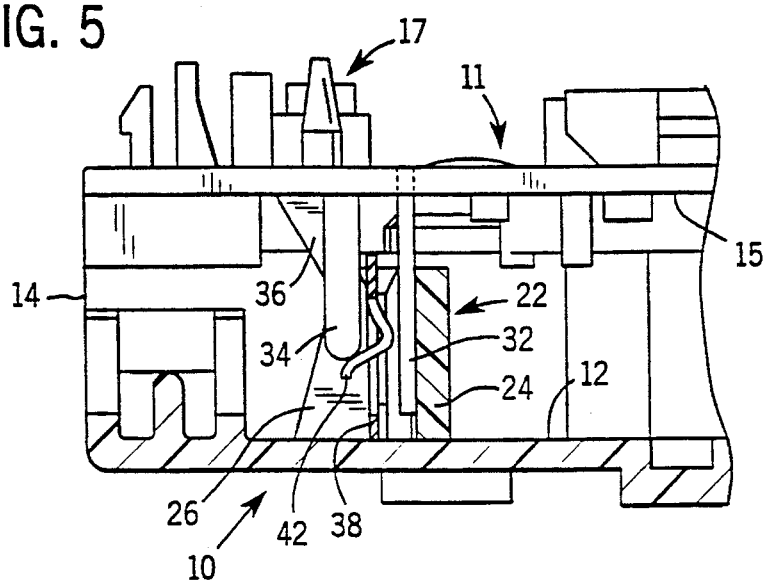
FIG. 5 is a partially sectioned detail view of the invention illustrated in FIGS. 1–3 showing two housing portions partially engaged.

FIG. 5 is a partially sectioned detail view of the invention illustrated in FIGS. 1–3 showing two housing portions partially engaged. In FIG. 5, housing portion 11 is close to full engagement with housing portion 10 in the process of forming a housing assembly, such as housing assembly 13 of FIG. 2. In FIG. 5, pin member 34 is in abutting relation with contact member 42, with there remaining some distance available for movement of housing portion 11 toward housing portion 10 in assembling a housing assembly.

Figure 6:
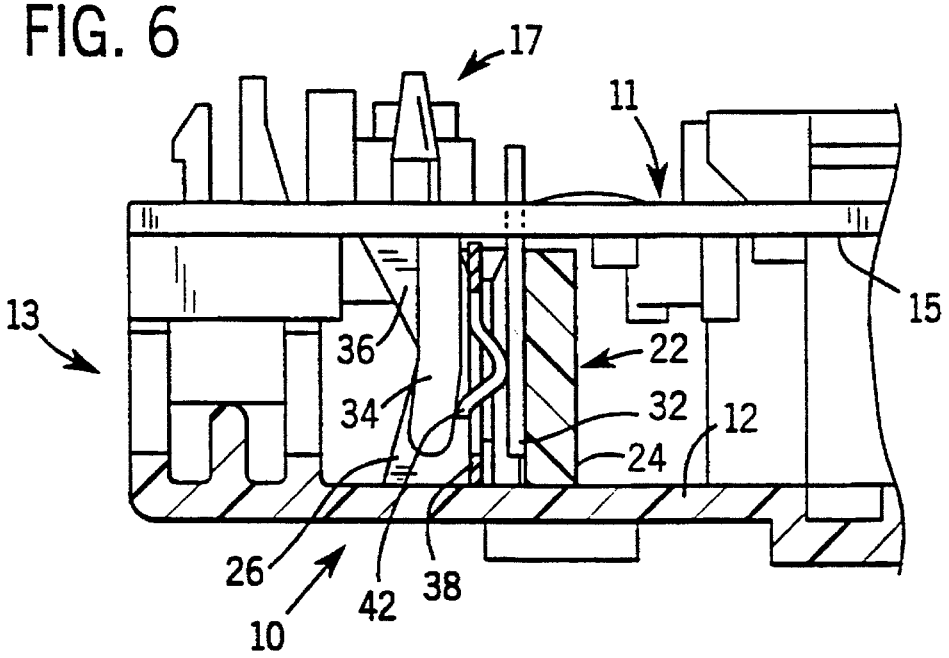
FIG. 6 is a partially sectioned detail view of the invention illustrated in FIGS. 1–3 showing two housing portions fully engaged.

FIG. 6 is a partially sectioned detail view of the invention illustrated in FIGS. 1–3 showing two housing portions fully engaged. In FIG. 6, housing portion 11 is fully engaged with housing portion 10 to form a housing assembly 13. Pin member 34 has displaced contact member 42 toward electrical lead 32, urging contact member 42 into physical and, consequently, electrical contact with electrical lead 32. In FIG. 6, it is illustrated that pin member 34 may have a resilient property in the fully engaged orientation of housing portions 10, 11. This resilient property results in pin member 34 flexing away from contact member 42 in the fully engaged orientation illustrated in FIG. 6. Such a resilient property is optional and is not required in the design of the present invention. Such a resilient property which results in a bending of pin member 34 away from electrical lead 32 and contact member 42 provides a sort of overtravel feature and lends some manufacturing tolerance forgiveness in forming the various components of the present invention. Of course, an important feature of the invention is that pin member 34 travel substantially parallel with electrical lead 32 during assembly of housing portions 10, 11 and displaces contact member 42 into physical and electrical contact with electrical lead 32. Another pin member, similar to pin member 34, urges contact member 40 (FIG. 3) toward an electrical lead 30 (FIGS. 1, 3) to couple electrical leads 30, 32 in electrical common through contact members 40, 42 and base member 38 (FIG. 3).

Figure 7:
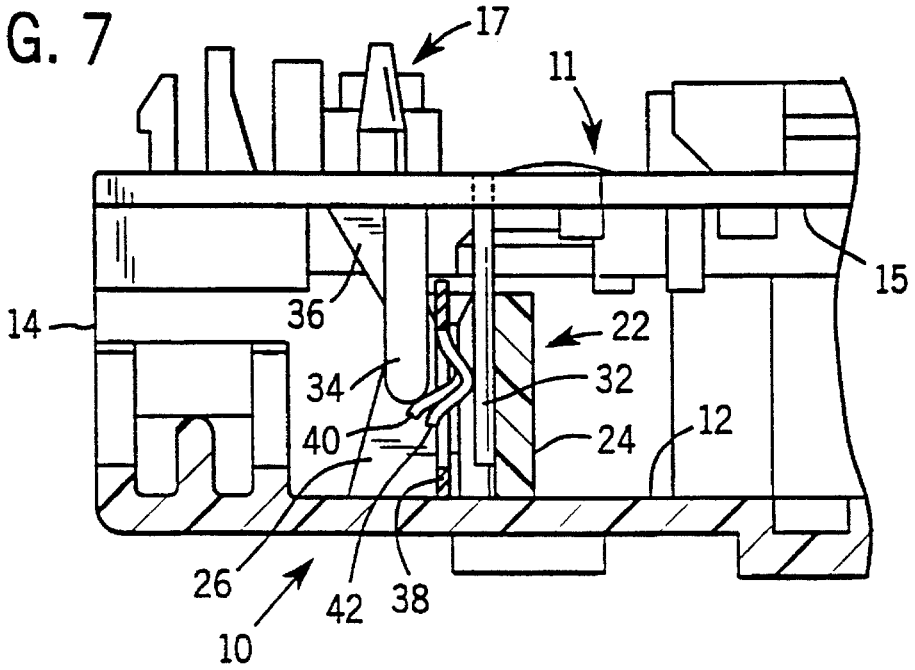
FIG. 7 is a partially sectioned detail view of the invention illustrated in FIGS. 1–3 similar to the view illustrated in FIG. 5, but illustrating the effect of a distorted contact member during assembly of the housing.

FIG. 7 is a partially sectioned detail view of the invention illustrated in FIGS. 1–3 similar to the view illustrated in FIG. 5, but illustrating the effect of a distorted contact member during assembly of the housing. In FIG. 7, housing portion 11 is in initial engagement with housing portion 10. Contact members 40, 42 are not equally oriented with respect to base member 38 so that a pin member similar to pin member 34 (not shown in FIG. 7) engages contact member 40 at a different time during assembly of housing portions 10, 11 than the time at which pin member 34 engages contact member 42. As engagement of housing portions 10, 11 continues, each of contact members 40, 42 are eventually urged toward their respective electrical leads 30, 32 to effect electrical in-common connection through base member 38. Thus, even if manufacturing tolerances permit uneven displacement of contact members 40, 42 from base member 38 (or if such uneven displacement occurs during handling, assembly, or other operations) the structure of the present invention is forgiving of such differences and operates to correct those differences to uniformly urged contact members 40, 42 against their respective electrical leads 30, 32 when housing portions 10, 11 are engaged.

Figure 8:
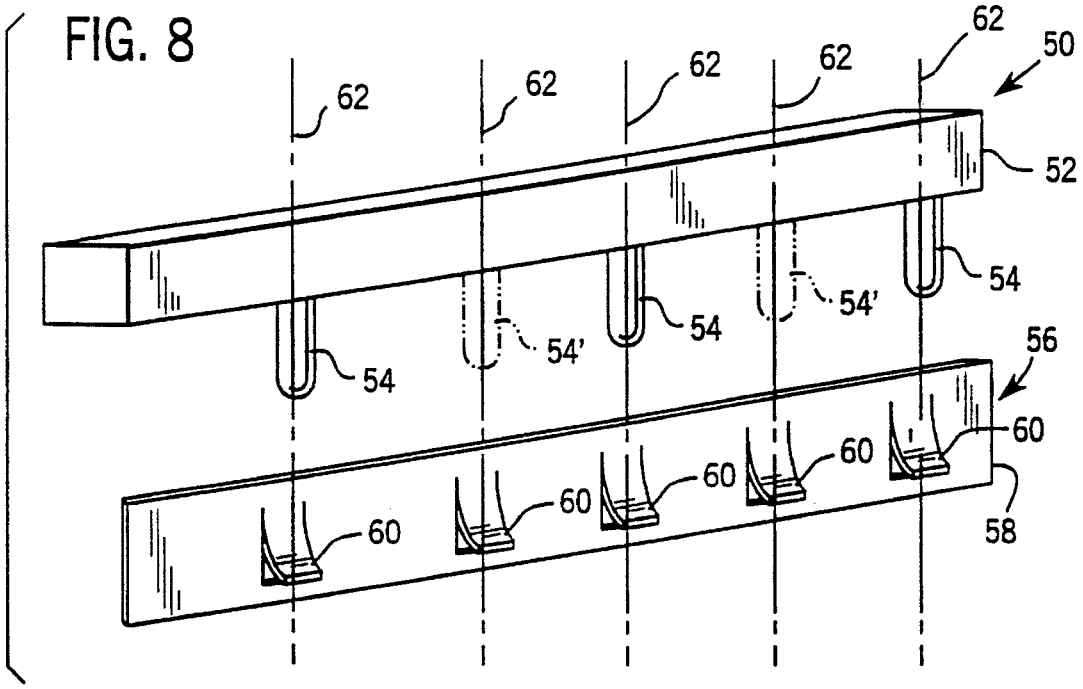
FIG. 8 is a perspective schematic view of portions of a first alternate embodiment of the present invention.

FIG. 8 is a perspective schematic view of portions of a first alternate embodiment of the present invention. In FIG. 8, a pin array 50 is illustrated comprising a base member 52 and a plurality of pins 54, 54'. In substantial register with pin array 50 is a contact array 56 which includes a base member 58 and a plurality of contact members 60. Thus, each respective pin 54, 54' is aligned with a respective contact member 60 along a respective axis 62. Pins 54' are indicated in phantom to indicate that they may be removed from pin array 50 after manufacture (e.g. by breaking off or cutting off a pin 54') or may be omitted from pin array 50 during manufacture. By such a configuration, a single pin array 50 may be tooled up to be produced in the configuration illustrated in FIG. 8 but may, for particular applications, have one or more of pins 54' removed because, in the particular application for which those pins 54' are removed, its respective contact member 60 is not to be electrically engaged.

Figure 9:
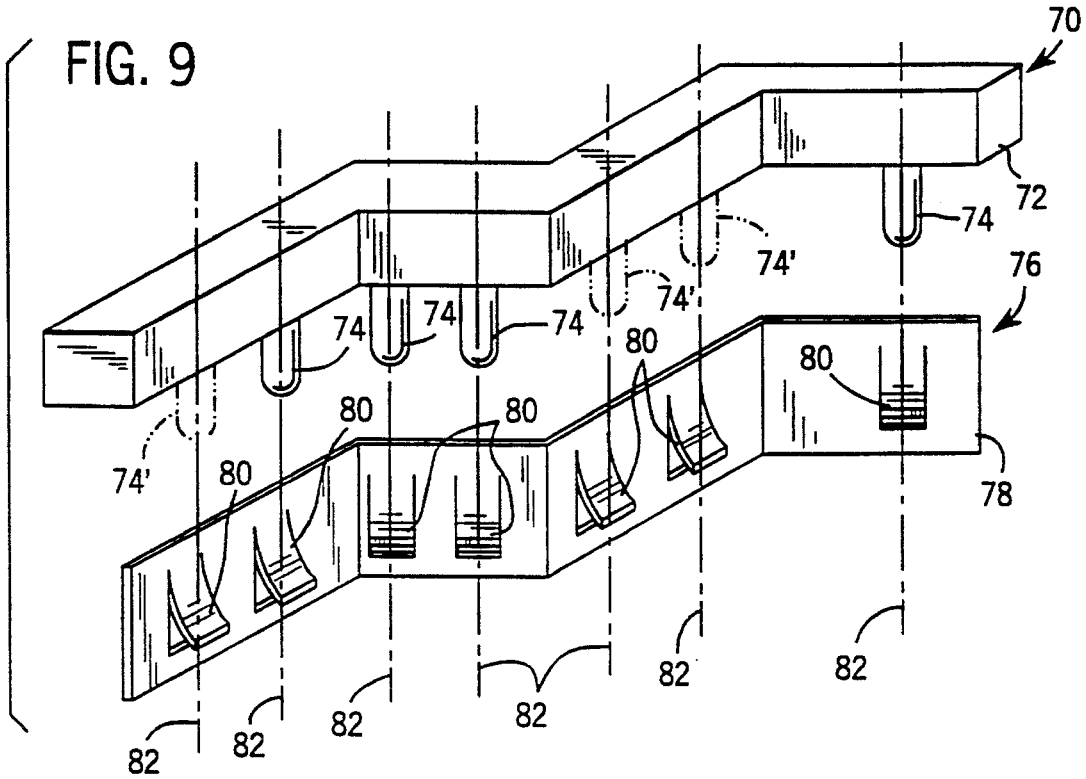
FIG. 9 is a perspective schematic view of portions of a second alternate embodiment of the present invention.

FIG. 9 is a perspective schematic view of portions of a second alternate embodiment of the present invention. In FIG. 9, a pin array 70 is illustrated as including a base member 72 and a plurality of pins 74, 74'. In the second alternate embodiment illustrated in FIG. 9, base member 72 is a generally serpentine base member having a plurality of segments non-linearly arranged. Consequently, there is provided a contact array 76 which includes a base member 78 and a plurality of contact members 80; base member 78 is serpentinely arranged generally in register with pin array 70 so that each respective contact member 80 is aligned with a respective pin 74, 74' along a respective axis 82.

In a manner similar to the alternate embodiment indicated in FIG. 8, selected pins 74' may be removed from an already standardly manufactured (e.g., molded) base member 72 so that selected respective contact members 80 will not be displaced when a housing portion fixedly arranged with base member 72 is engaged with a housing portion fixedly arranged with respect to base member 78 during assembly of the two housing portions to form a housing assembly, as generally described in connections with FIGS. 1–3. Such a selectively removable pin 74' capability or structure provides a programmability feature for the present invention in all of its embodiments illustrated in FIGS. 1–9.

It is to be understood that, while the details, drawings and specific examples given describe preferred embodiments, they are for the purpose of illustration, that the apparatus of the invention is not limited to the precise details and conditions disclosed, and that various changes may be made therein without departing from the spirit of the invention which is defined by the following claims.

I claim:

1. An improved system for selectively effecting electrical connection intermediate a plurality of electrical leads at a plurality of loci in a housing; said housing including a first housing portion and a second housing portion, said first housing portion and said second housing portion being configured to engage in a predetermined orientation during assembly of said housing; the system comprising:

an electrical bridging member; said bridging member being located in one housing portion of said first housing portion and said second housing portion; said bridging member having a plurality of bias units, each respective bias unit of said plurality of bias units being situated substantially at a respective locus of said plurality of loci; an electrical device being located in said one housing portion, said device having a plurality of components, selected components of said plurality of components being electrically coupled to said plurality of electrical leads at said plurality of loci; and a bearing member; said bearing member being located in the other housing portion of said first housing portion and said second housing portion than said one housing portion; said bearing member including a plurality of urging units, said plurality of urging units including a respective urging unit substantially in register with each said respective locus when said first housing portion and said second housing portion are in said predetermined orientation; said plurality of urging units cooperating with said plurality of bias units during said assembly to bias each said respective bias unit against a respective electrical lead of said plurality of electrical leads at each said respective locus to selectively electrically connect said respective electrical leads to each other.

2. An improved system for selectively effecting electrical connection intermediate a plurality of electrical leads at a plurality of loci in a housing as recited in claim 1 wherein said plurality of electrical leads is two electrical leads.

3. An improved system for selectively effecting electrical connection intermediate a plurality of electrical leads at a plurality of loci in a housing as recited in claim 1 wherein each said respective bias unit comprises a respective spring steel finger member biased away from its respective electrical lead, said respective urging unit urging said respective finger member against said respective electrical lead during said assembly.

4. An improved system for selectively effecting electrical connection intermediate a plurality of electrical leads at a plurality of loci in a housing as recited in claim 1 wherein each said respective urging unit is made of electrically insulating material.

5. An improved system for selectively effecting electrical connection intermediate a plurality of electrical leads at a plurality of loci in a housing as recited in claim 4 wherein said other housing portion is fabricated of electrically insulative material and each said respective urging unit is integrally formed with said other housing portion.

6. An improved system for selectively effecting electrical connection intermediate a plurality of electrical leads at a plurality of loci in a housing as recited in claim 2 wherein each said respective bias unit comprises a respective spring steel finger member biased away from its respective electrical lead, said respective urging unit urging said respective finger member against said respective electrical lead during said assembly.

7. An improved system for selectively effecting electrical connection intermediate a plurality of electrical leads at a plurality of loci in a housing as recited in claim 2 wherein each said respective urging unit is made of electrically insulating material.

8. An improved system for selectively effecting electrical connection intermediate a plurality of electrical leads at a plurality of loci in a housing as recited in claim 7 wherein the other housing portion is fabricated of electrically insulative material and each said respective urging unit is integrally formed with said other housing portion.

9. An improved system for selectively effecting electrical connection intermediate a plurality of electrical leads at a plurality of loci in a housing as recited in claim 3 wherein each said respective urging unit is made of electrically insulating material.

10. An improved system for selectively effecting electrical connection intermediate a plurality of electrical leads at a plurality of loci in a housing as recited in claim 9 wherein the other housing portion is fabricated of electrically insulative material and each said respective urging unit is integrally formed with said other housing portion.

11. A housing for an electrical device; said device having a plurality of components; selected components of said plurality of components having a plurality of electrical leads; selected electrical leads of said plurality of electrical leads being substantially fixed at a plurality of loci, said selected electrical leads requiring electrical connection according to a predetermined pattern of connection during assembly of said device within the housing; the housing comprising;

a first housing portion configured to house said electrical device; said first housing portion substantially fixedly positioning said device for assembly when said first housing portion is in a predetermined orientation; said plurality of electrical leads being substantially fixed at said plurality of loci when said first housing portion is in said predetermined orientation;

a bridging structure; said bridging structure being configured for effecting said predetermined pattern of connection and being substantially fixedly located with respect to said first housing portion when said first housing portion is in said predetermined orientation; and a second housing portion having jamming structures; said jamming structures being located and configured to cooperate with said first housing portion and with said bridging structure during mating engagement of said first housing portion and said second housing portion to effect said assembly, said mating engagement urging said bridging structure against said electrical leads to establish said predetermined pattern of connection between said selected electrical leads during said assembly.

12. A housing for an electrical device as recited in claim 11 wherein said plurality of electrical leads is two electrical leads.

13. A housing for an electrical device as recited in claim 11 wherein said bridging structure includes a respective electrically conductive member biased away from each said selected electrical lead, said jamming structure urging said respective electrically conductive member against said selected electrical leads during said assembly.

14. A housing for an electrical device as recited in claim 11 wherein said jamming structure is made of electrically insulating material.

15. A housing for an electrical device as recited in claim 14 wherein said second housing portion is fabricated of electrically insulative material and said jamming structure is integrally formed with said second housing portion.

16. A housing for an electrical device as recited in claim 12 wherein said bridging structure includes a respective electrically conductive member biased away from each said selected electrical lead, said jamming structure urging said respective electrically conductive member against said selected electrical leads during said assembly.

17. A housing for an electrical device as recited in claim 12 wherein each said jamming structure is made of electrically insulating material.

18. A housing for an electrical device as recited in claim 17 wherein said second housing portion is fabricated of electrically insulative material and said jamming structure is integrally formed with said second housing portion.

19. A housing for an electrical device as recited in claim 13 wherein each said jamming structure is made of electrically insulating material.

20. A housing for an electrical device as recited in claim 19 wherein said second housing portion is fabricated of electrically insulative material and said jamming structure is integrally formed with said second housing portion.

21. A system for effecting an electrical connection, comprising:

a first housing portion having an electrically conductive bridging structure;

an electrical device electrically coupled to a plurality of electrical leads; and a second housing portion having a plurality of jamming structures, the second housing portion configured for mating engagement with the first housing portion to enclose the electrical device;

wherein the electrical leads are spaced from the bridging structure when the housing portions are not in mating engagement, and the plurality of jamming structures urge the bridging structure into engagement with the plurality of electrical leads when the housing portions are in mating engagement to effect the electrical connection between the electrical leads.

* * * * *